US005906124A

United States Patent [19]

Su

[11] Patent Number: 5,906,124

[45] Date of Patent: May 25, 1999

[54] LOCK ASSEMBLY

[76] Inventor: Shun-Chang Su, No. 11, Ping Ho Road, Lu Gang Cheng, Chang Hua Hsien, Taiwan

[21] Appl. No.: 09/003,019

[22] Filed: Jan. 5, 1998

[51] Int. Cl.[6] ..... E05B 37/02

[52] U.S. Cl. ..... 70/312; 70/69; 70/213

[58] Field of Search ..... 70/213, 214, 217, 70/220, 312, 69, 70, 71, 72, 74, 75

[56] References Cited

U.S. PATENT DOCUMENTS

| | | | |
|---|---|---|---|
| 3,434,314 | 3/1969 | Atkinson | 70/312 |
| 3,776,006 | 12/1973 | Atkinson | 70/312 |
| 4,155,234 | 5/1979 | Bako | 70/312 |
| 4,499,745 | 2/1985 | Ricouard et al. | 70/312 |
| 4,557,122 | 12/1985 | Hwang | 70/312 |
| 4,651,545 | 3/1987 | Diiringer | 70/316 |
| 4,732,021 | 3/1988 | Su | 70/312 |
| 4,852,372 | 8/1989 | Ling | 70/312 |
| 4,866,959 | 9/1989 | Ling | 70/25 |
| 4,914,931 | 4/1990 | Shu | 70/213 |
| 4,926,663 | 5/1990 | Azzalin | 70/312 |
| 4,974,432 | 12/1990 | Blake | 70/312 |
| 5,211,040 | 5/1993 | Gisiger | 70/71 |
| 5,396,785 | 3/1995 | Chen | 70/312 |
| 5,408,853 | 4/1995 | Yamada | 70/210 |
| 5,609,048 | 3/1997 | Ling | 70/312 |

FOREIGN PATENT DOCUMENTS

| | | | |
|---|---|---|---|
| 236909 | 3/1945 | Switzerland | 70/312 |

*Primary Examiner*—Steven Meyers
*Assistant Examiner*—Stephen Grady
*Attorney, Agent, or Firm*—Charles E. Baxley, Esq.

[57] ABSTRACT

A lock assembly includes a base member having a bottom with a peripheral wall extending from a periphery defining the bottom, two rods extending from the bottom and two openings defined through the peripheral wall. Each of the rods has a board and a disk respectively and rotatably mounted thereto which is accessed via the openings. Each of the boards has a protrusion extending therefrom which has two sides. A slide has a slot defined therethrough so as to slidably mount to the rods. A periphery defining the slot has two pairs of opposite sides, a width between each of the two opposite sides being smaller than a length of the protrusion and larger than a width between the two sides of the protrusion. The movement of the slide actuates a limit device disposed to the lock assembly.

7 Claims, 6 Drawing Sheets

LOCK ASSEMBLY

BACKGROUND OF THE INVENTION

1. Field of the Invention

The present invention relates to a lock assembly and, more particularly, to an improved lock assembly for a suitcase and/or letter box and including a slide movably disposed relative to at least one set of number setting means which is controllably adjusted to control the slide.

2. Brief Description of the Prior Art

A lock assembly is commonly used to limit two parts, such as a base and a cover of a letter box or a suitcase, being separated to each other so as to keep from access in the letter box. Some of the lock assemblies are equipped with a key which is used to open the lock assembly. However, most of the keys of the lock assemblies are very small and are easily to be lost. Furthermore, if the lock assembly is disposed to a letter box which generally stands outside, the lock assembly tends to get rust. Some lock assemblies need no key at all, but they involve complicated structure and high manufacturing cost.

The present invention intends to provide an improved lock assembly to mitigate and/or obviate the above-mentioned problems.

SUMMARY OF THE INVENTION

In one aspect of the present invention, there is provided a lock assembly comprising a base member having a bottom with a peripheral wall extending from a periphery defining the bottom. At least two rods extend from the bottom and at least two openings are defined through the peripheral wall so as to access the rods via the openings. Each of the rods has a disk and a board respectively and rotatably mounted thereto and each of the boards has a protrusion extending therefrom which has two sides. The disks are able to be accessed from the openings.

A slide has a slot defined therethrough so as to slidably mount to the rods, wherein a periphery defining the slot has at least two pairs of opposite sides. A width between each of the two opposite sides is smaller than a length of the protrusion and larger than a width between the two sides of the protrusion. The movement of the slide actuates a limit means disposed to the lock assembly.

It is an object of the present invention to provide a lock assembly having a slide disposed therein which actuates a limit means of the lock assembly.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
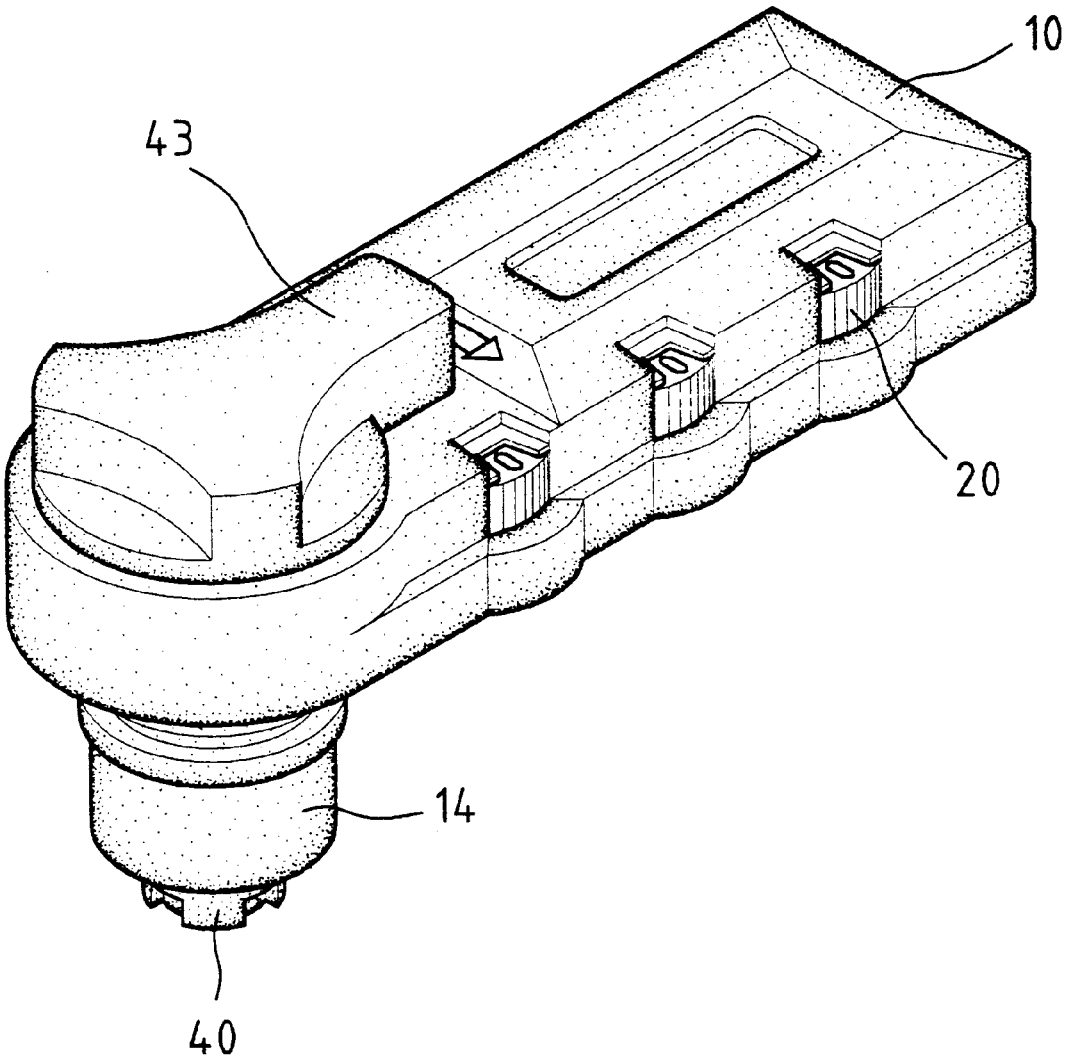
FIG. 1 is a perspective view of a lock assembly in accordance with the present invention.
Figure 2:
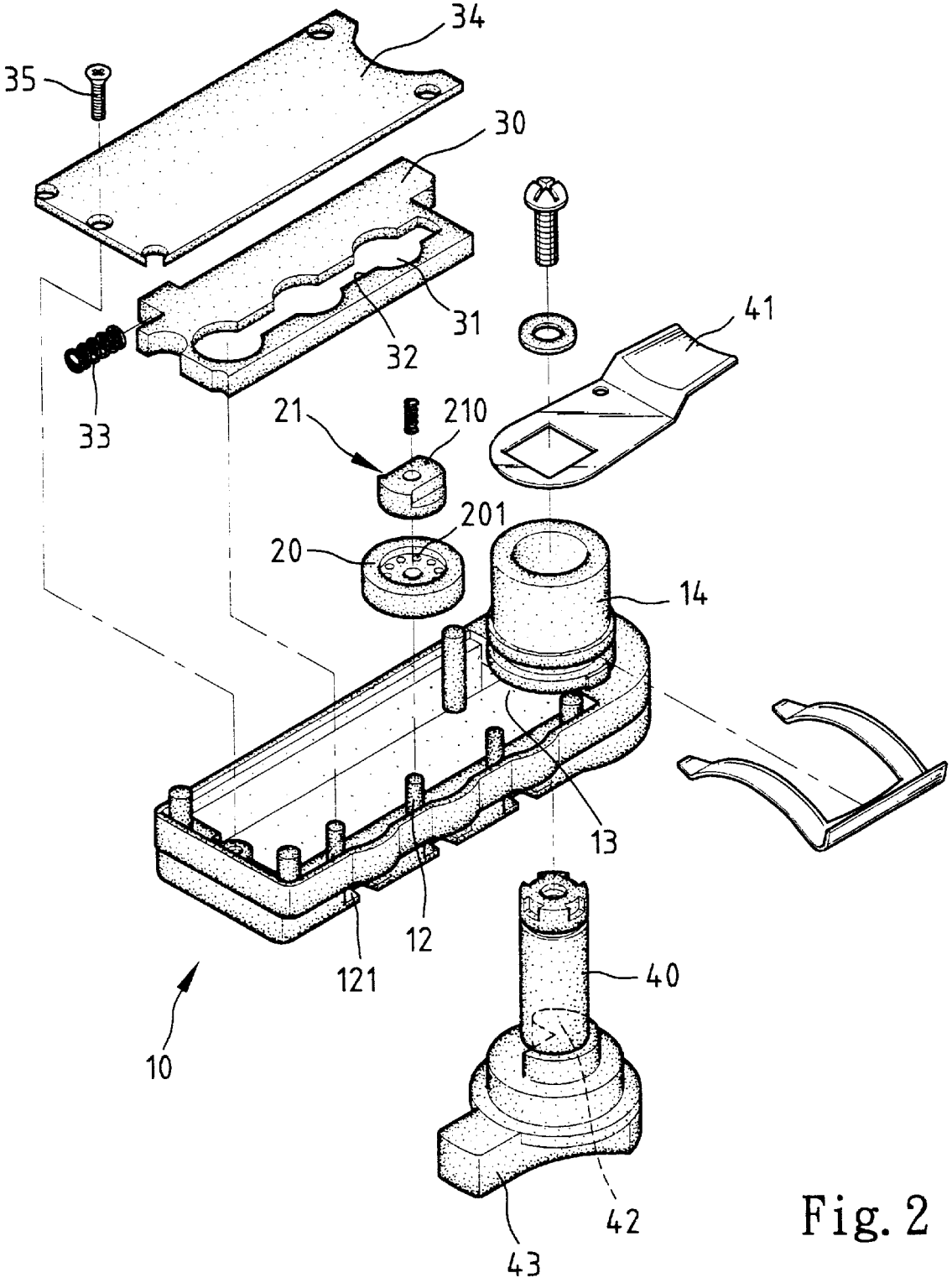
FIG. 2 is an exploded view of the lock assembly in accordance with the present invention.

Referring to the drawings and initially to FIGS. 1 and 2, a lock assembly in accordance with the present invention generally includes a base member 10 having a bottom 11 with a peripheral wall extending from a periphery defining the bottom 11, three rods 12 extending from the bottom 11 and at three openings 121 defined through the peripheral wall so as to access the rods 12 via the openings 121. A tube 14 extends from one of two ends of the base member 10 and an aperture 13 defined through the peripheral wall, wherein the aperture 13 is located beneath the tube 14.

Each of the rods 12 has a disk 20 and a board 21 are respectively and rotatably mounted thereto. Each of the boards 21 has a protrusion 210 extending therefrom which has two sides, and the disks 20 can be accessed from the openings 121. Numbers 0 through 9 (as shown in FIG. 1) are marked on a top surface of each of the disks 20. The disks 20 each have a plurality of bosses 201 extending from the top surface thereof and the two boards 21 each have a plurality of cavities 211 defined in an underside thereof so that the boards 21 are rotated with the disks 20 when at least one of the bosses 201 are received in a specific cavity 211.

A slide 30 has a slot 31 defined therethrough so as to slidably mount to the rods 12. A periphery defining the slot 31 has three pairs of opposite sides 32, a width between each of the two opposite sides 32 being smaller than a length of the protrusion 210 and larger than a width between the two sides of the protrusion 210. A spring 33 is disposed between a first end of the slide 30 and the peripheral wall of the base member 10, a second end of the slide 30 inserted through the aperture 13.

A cover 34 is fixedly disposed to the base member 10 by a bolt 35 so as to receive the slide 30 between the bottom 11 of the base member 10 and the cover 34.

A limit means is disposed to the base member 10 and controlled by a movement of the slide 30. The limit means includes a shaft 40 rotatably extending through the tube 14 on the base member 10 and a tongue 41 is fixedly connected to a distal end of the shaft 40. The shaft 40 has a second protrusion 42, such as a cam means, extending radially therefrom. A lever 43 extends laterally to the shaft 40 that when pushing the lever 43, the shaft 40 is rotated. The second protrusion 42 contacts the second end of the slide 30.

Figure 4:
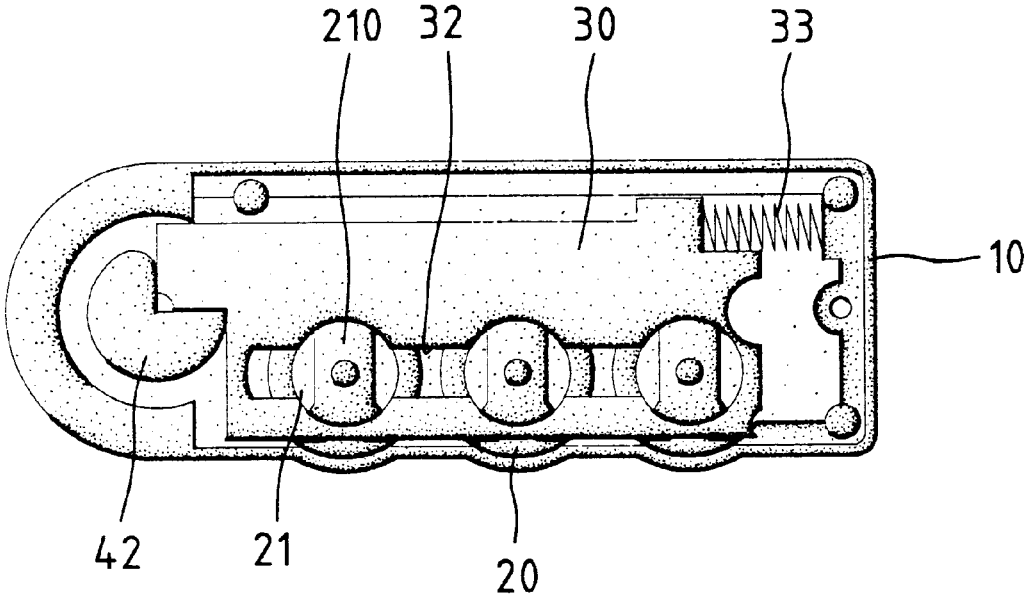
FIG. 4 is an illustrative view to show when a slide of the lock assembly is in a locked position.
Figure 5:
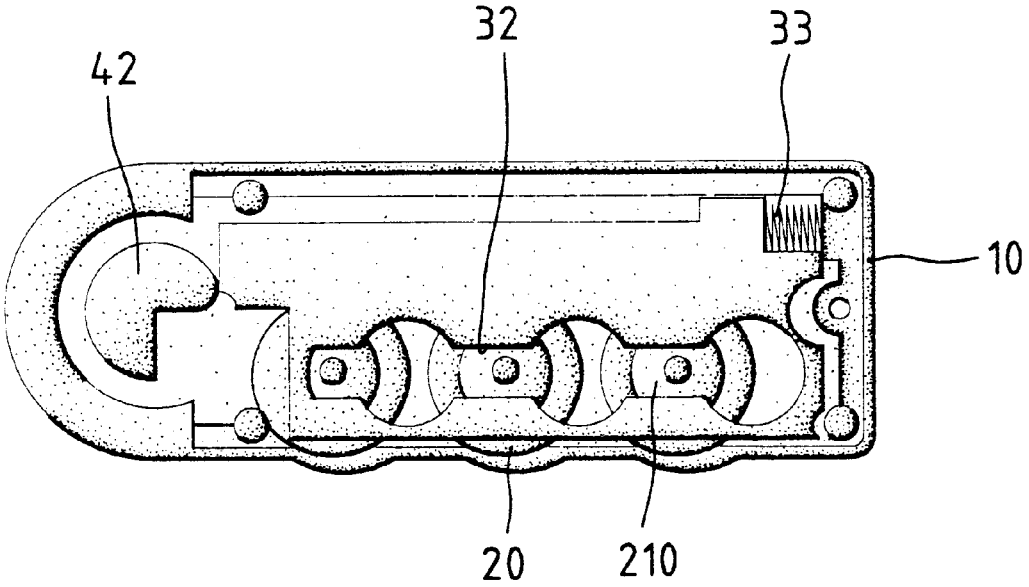
FIG. 5 is an illustrative view to show when a slide of the lock assembly is in an opened position.

Referring to FIG. 4, when the two sides of the protrusion 210 are located perpendicular to any of the opposite sides 32 and the boards 21 are respectively inserted through the slot 31, the slide 30 is limited from being moved for the width between the opposite sides 32 being smaller than the length of the protrusion 210. The tongue 41 now is in a locked position. Referring to FIG. 5, when rotating the disks 20 to a certain position, the two sides of the protrusion 310 are parallel to the opposite sides 32 so that the slide 30 is able to be moved by pushing the lever 43. The shaft 40 is rotated with the movement of the lever 43 so as to shift the tongue 41 to an opened position.

Figure 3:
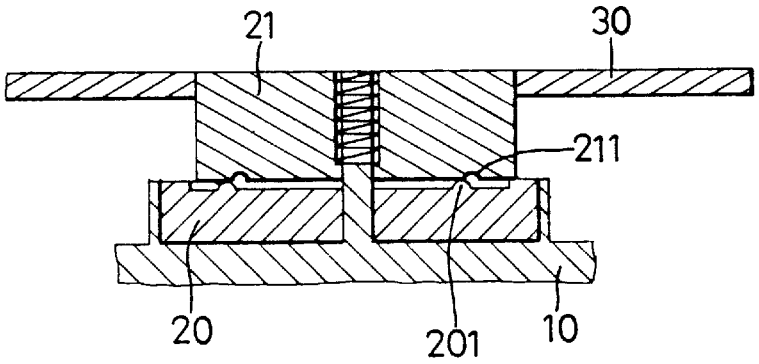
FIG. 3 is a side elevational view, partly in section, of a board disposed to a disk of the present invention.

FIG. 3 shows how to preset or change the unlock number on the disks 20. The bosses 201 are first moved to a position not received in the cavities 211 as shown, then rotating each of the disks 20 to let a specific cavity 211 which is located corresponding to a specific number on the disk, receives a boss 201. Therefore, the board 21 can be rotated with the disk 20 corresponding thereto only when the disk 20 is rotated to show the preset number via the opening 121.

Figure 7:
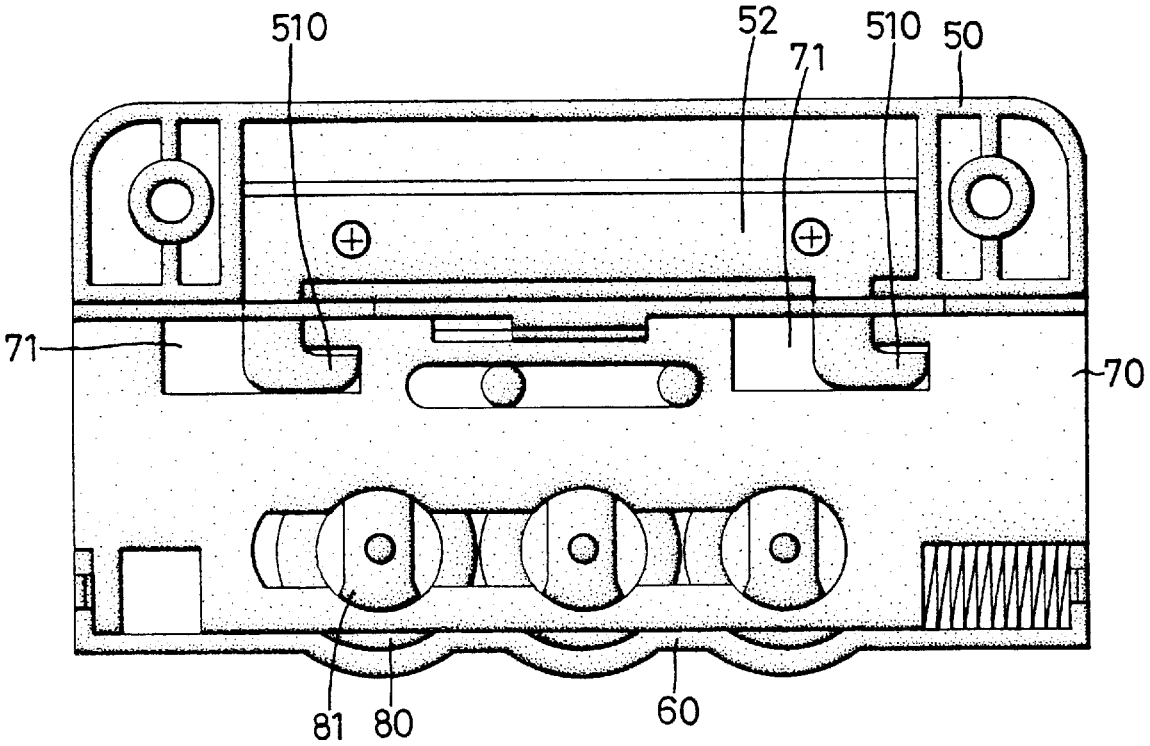
FIG. 7 is an illustrative view to show when the lock assembly shown in FIG. 6 is in a locked position.
Figure 6:
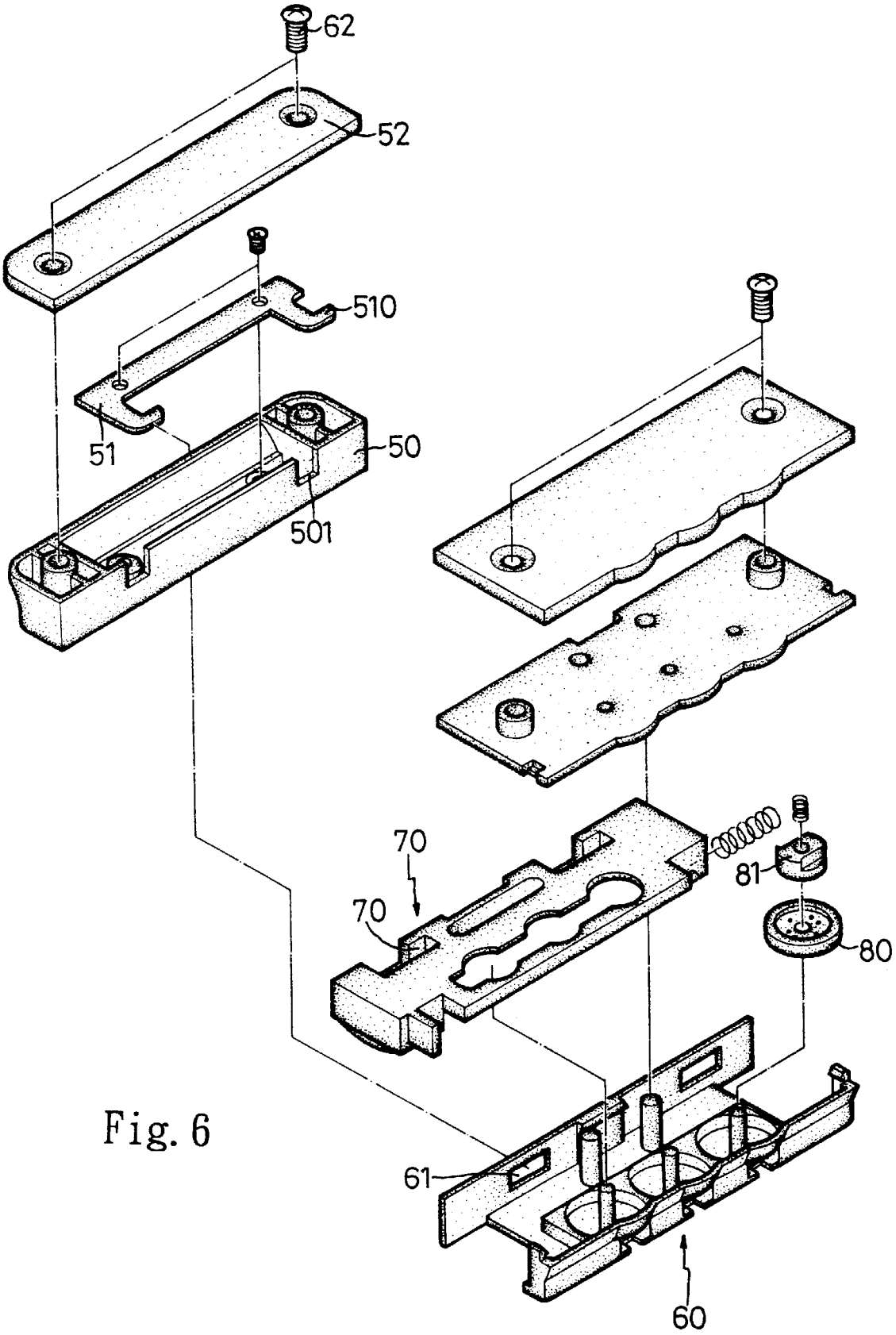
FIG. 6 is an exploded view of a second embodiment of the lock assembly in accordance with the present invention.
Figure 8:
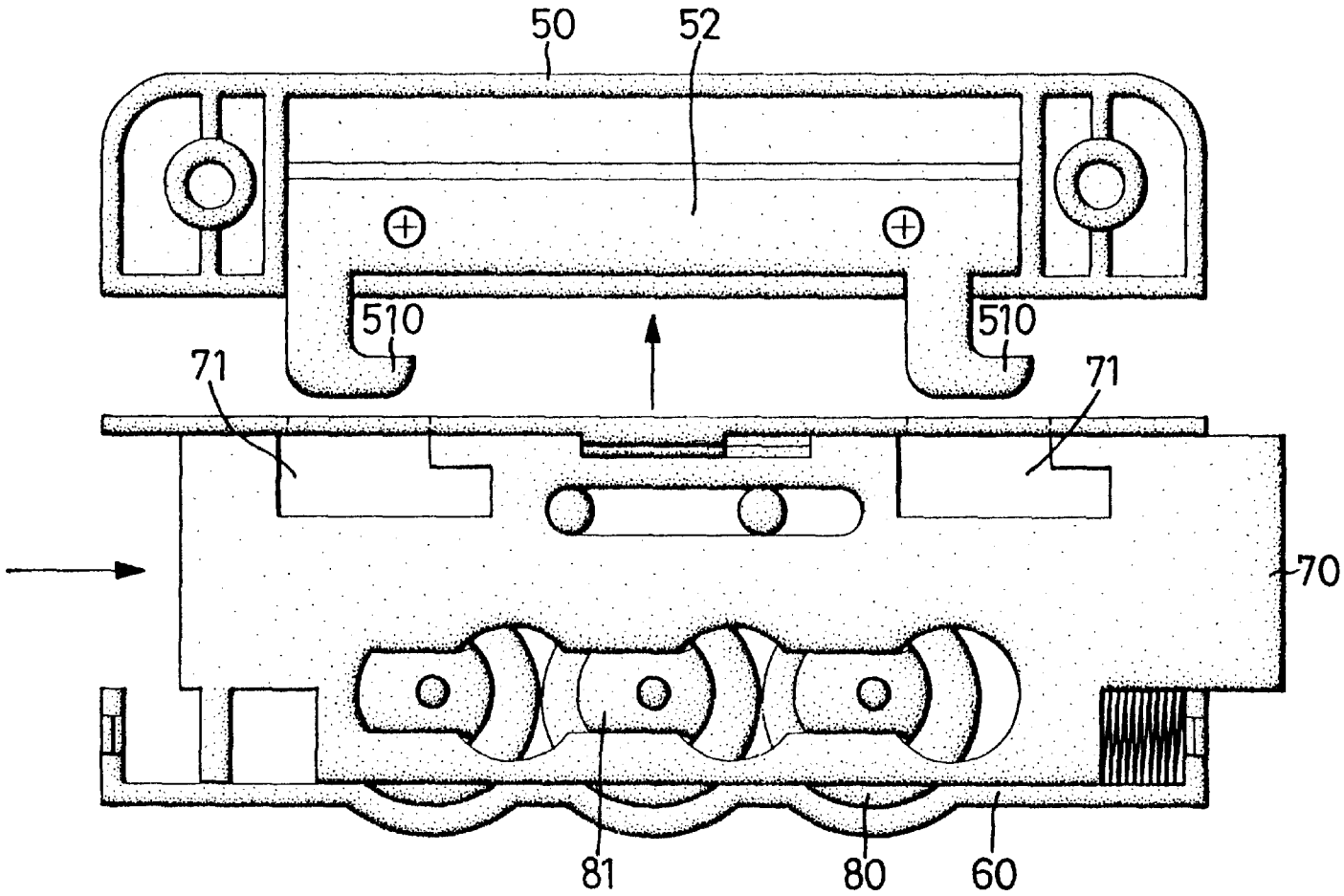
FIG. 8 is an illustrative view to show when the lock assembly shown in FIG. 6 is in an opened position.

FIGS. 6 through 8 show a second embodiment of the lock assembly of the present invention, the second embodiment includes two parts, one of which is similar to that of the first embodiment mentioned above except the shaft 40, the tube 14 and the tongue 41, the other part of the second embodiment is a fixedly portion which is fixedly connected to one of two halves of a suitcase for example. The second part has a lower member 50 receiving a plate 51 therein and an upper member 52 which is fixedly connected to the lower member 50 by bolts 62. The plate 51 has two hooks 510 which extend through two recesses 501 defined in the lower member 50. The base member 60 of the first part has two holes 61 defined through a peripheral wall thereof and a slide 70 is slidably received in the base member 60. Similar to the first embodiment, the slide 70 is also controlled by three sets of disks 80 and boards 81. The slide 70 has two L-shaped recesses 71 defined in one of two sides thereof, the two L-shaped recesses 71 located corresponding to the two holes 61. When in a locked position, the two hooks 510 are received in the two L-shaped recesses 71 of the slide 70 via the two holes 61. The slide 70 is limited from being moved if a proper process of the disks 80 and the boards 81 is not operated. When the proper process is operated to the disks 80 and the boards 81, the slide 70 is allowed to slide and the two hooks 510 are then removed from the L-shaped recesses 71 so as to separate the first and the second part.

Although the invention has been explained in relation to its preferred embodiment, it is to be understood that many other possible modifications and variations can be made without departing from the spirit and scope of the invention as hereinafter claimed.

What is claimed is:

1. A lock assembly comprising:

a base member having a bottom with a peripheral wall extending from a periphery defining said bottom, at least two rods extending from said bottom and at least two openings defined through said peripheral wall so as to access said rods via said openings;

each of said rods having a disk and a board respectively and rotatably mounted thereto, each of said boards having a protrusion extending therefrom which has two sides, said disks being accessed from said openings, and a slide having a slot defined therethrough so as to slidably mount to said rods, a periphery defining said slot having at least two pairs of opposite sides, a width between each of said two opposite sides being smaller than a length of said protrusion and larger than a width between said two sides of said protrusion, and limit means disposed on said base member, with said limit means controlled by movement of said slide;

a tongue attached to said limit means; with said slide capable of a locked position wherein said limit means is prevented from rotation and an unlocked position wherein said limit means is capable of rotation thereby unlocking said lock assembly.

2. The lock assembly as claimed in claim 1 wherein a spring is disposed between said slide and said peripheral wall of said base member.

3. The lock assembly as claimed in claim 1 wherein said two disks each have a plurality of bosses extending from a top surface thereof and said two boards each have a plurality of cavities defined in an underside thereof, said boards being rotated with said disks when said bosses are received in said cavities.

4. The lock assembly as claimed in claim 1 wherein each of said disks has numbers marked thereon.

5. A lock assembly comprising:

a base member having a bottom with a peripheral wall extending from a periphery defining said bottom, at least two rods extending from said bottom and at least two openings defined through said peripheral wall so as to access said rods via said openings;

each of said rods having a disk and a board respectively and rotatably mounted thereto, each of said boards having a protrusion extending therefrom which has two sides, said disks being accessed from said openings, and a slide having a slot defined therethrough so as to slidably mount to said rods, a periphery defining said slot having at least two pairs of opposite sides, a width between each of said two opposite sides being smaller than a length of said protrusion and larger than a width between said two sides of said protrusion, limit means disposed on said base member; wherein said limit means includes a shaft rotatably extending through said base member and a tongue fixedly connected to said shaft, said shaft having a second protrusion extending radially therefrom so as to push said slide.

6. The lock assembly as claimed in claim 5 wherein said base member has an aperture defined in said peripheral wall thereof so that said second protrusion contacts one of two ends of said slide.

7. The lock assembly as claimed in claim 5 wherein said shaft has a lever extending laterally therefrom so as to rotate said shaft.

* * * * *